United States Patent [19]

Saito et al.

[11] 4,443,273

[45] Apr. 17, 1984

[54] METHOD FOR REPLENISHING CHEMICAL IN ZINC PHOSPHATE TREATMENT

[76] Inventors: Koichi Saito, Teramachi Oike Agaru Nakagyo-ku Kyoto-Shi 604; Yasutake Mino, 1-17, Fukaeminamimachi Higashinada-ku Kobe-Shi 658; Nobuo Nakatani, 1-4-31-201, Motoyamanakamachi Higashinada-ku Kobe-Shi 658; Ryoichi Murakami, 82-1 Hokkeji-cho, Nara-Shi 630, all of Japan

[21] Appl. No.: 332,700

[22] Filed: Dec. 21, 1981

[30] Foreign Application Priority Data

Dec. 26, 1980 [JP] Japan ..... 55-186023

[51] Int. Cl.[3] ..... C23F 7/10

[52] U.S. Cl. ..... 148/6.15 Z

[58] Field of Search ..... 148/6.15 Z, 6.15 R

[56] References Cited

U.S. PATENT DOCUMENTS

| | | | |
|---|---|---|---|
| 2,316,811 | 4/1943 | Romig | 148/6.15 Z |
| 3,294,593 | 12/1966 | Wyszomiriski | 148/6.15 Z |
| 3,401,065 | 9/1968 | Steinbrecher | 148/6.15 Z |
| 4,071,379 | 1/1978 | Cooke et al. | 148/6.15 |
| 4,287,004 | 9/1981 | Murakami et al. | 148/6.15 |

FOREIGN PATENT DOCUMENTS

| | | | |
|---|---|---|---|
| 807730 | 1/1959 | United Kingdom | 148/6.15 Z |
| 1324460 | 7/1973 | United Kingdom | 148/6.15 Z |
| 1376309 | 12/1974 | United Kingdom | 148/6.15 R |

*Primary Examiner*—Sam Silverberg

*Attorney, Agent, or Firm*—Ernest G. Szoke; Henry E. Millson, Jr.

[57] ABSTRACT

A method for replenishing a nitrite accelerated zinc phosphate treating liquid for forming zinc phosphate coatings on metal surfaces, wherein the metal surface is treated at the rate of 3 to 15 $m^2$ per hour per cubic meter of treating liquid and the treating liquid is replenished with free phosphoric acid at the rate of 0.10 to 0.31 moles per 10 $m^2$ of treated surface area.

6 Claims, 1 Drawing Figure

METHOD FOR REPLENISHING CHEMICAL IN ZINC PHOSPHATE TREATMENT

Figure 1:
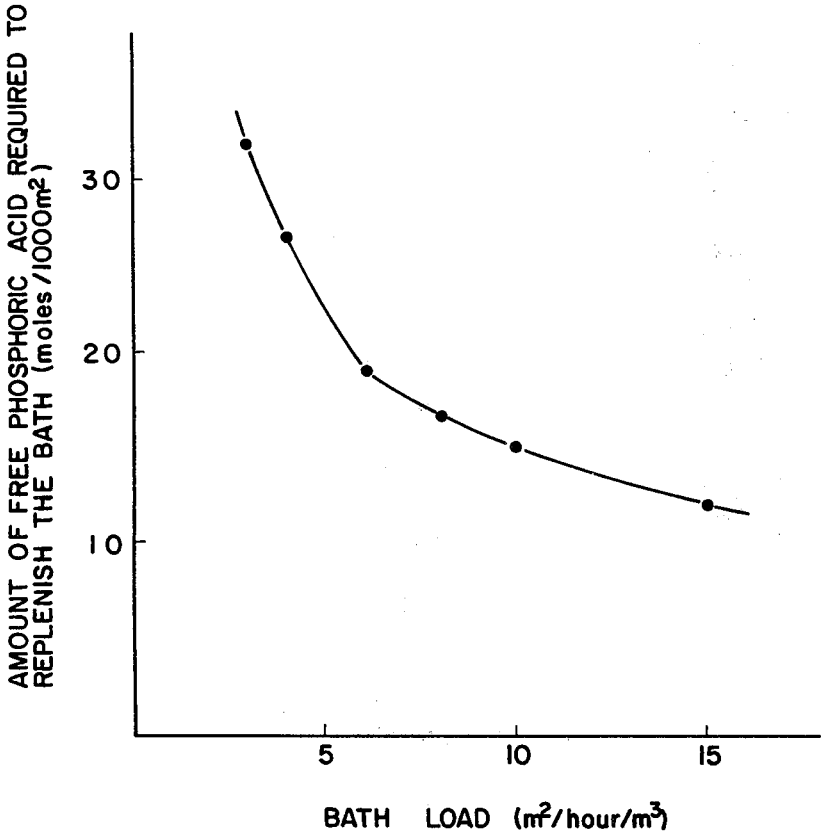

The present invention relates to a method for replenishing chemicals in a zinc phosphate coating bath. More particularly, it relates to a method for replenishing chemicals for continuous formation of a normal zinc phosphate coating on a metal surface in a process, such as dipping, wherein the surface area of metal treated per unit of time is small in proportion to the volume of bath required.

The "metal surface" herein used means a surface of iron, zinc or their alloys, particularly steel and galvanized steel.

Heretofore, various zinc phosphate treating methods have been employed. Spraying is generally used because of its high coating efficiency. However, conventional spraying has the disadvantage of leaving some portions unsprayed in articles having complex shapes and, consequently, good conversion coatings cannot be obtained evenly on all surface areas. Recently, dipping has been employed to minimize such problems, especially in applying conversion coatings to automobile bodies or parts, many of which have pockets and complicated structures.

Owing to the configuration of the metal articles (workpieces) being processed through the coating solution (bath) the volume of the bath is many times that required merely to wet the metal surface with coating solution as in the case of a spray process. Continuous processing of the workpiece through the bath may require even greater volume since the length of the bath must be increased in order that the workpiece remains immersed in the bath for a sufficient time to allow the formation of an adequate conversion coating as workpieces are moved continuously through the bath. The length of the bath is determined by the treatment time required and the desired rate for processing workpieces through the bath (line speed).

When converting from conventional spraying to dipping, the volume of treating liquid has to be increased about 5- to about 10-fold in comparison to conventional spraying, to make it possible to dip the article to be coated in the treating bath for a period of time sufficient for the coating forming reaction to take place (usually for about 1.5 to about 15 minutes) as disclosed in U.S. Pat. No. 4,287,004 (Japanese Patent Publication No. 76076/1980), whereby the surface area of metal treated per unit of time becomes substantially smaller in proportion to the volume of bath required.

The aqueous solution of coating chemicals generally employed in the formation of zinc phosphate coatings on steel or other metal surfaces must be maintained at effective coating concentrations while workpieces are processed through the bath. To do so requires continuous or intermittent replenishing of the chemical components of the bath. Since not all chemicals are depleted at the same rate it may be necessary to replenish with several replenishing compositions.

Generally two chemicals have been used heretofore as replenishers to maintain the bath in operating condition to form excellent continuous zinc phosphate coatings. The main replenishing chemical composition comprises phosphate ion, zinc ion and other metal ions for forming the coating and, optionally, one or more oxidizers such as chlorate ion, nitrate ion, etc. The other replenishing chemical composition is an acccelerator comprising mainly sodium nitrite. The main replenishing composition is used to replenish the amounts of bath components consumed by formation of the coating, sludge formation and bath drag out. The other replenishing composition is used to replenish the amount of accelerator consumed by the coating forming reaction and by spontaneous decomposition of the accelerator, e.g. nitrite. For example, as disclosed in U.S. Pat. No. 4,071,379 (Japanese Patent Publication No. 129828/1976), a zinc phosphate coating bath having a concentration of 0.5 to 5 g/l of zinc ion, 3 to 50 g/l of phosphate ion, 0.5 to 5 g/l of chlorate ion, and 0 to 15 g/l of nitrate ion, is maintained by replenishing with a first aqueous solution comprising 12.2% by weight of zinc oxide, 10.2% by weight of 59% nitric acid, 33.8% by weight of 81% phosphoric acid, and 7.9% by weight of sodium chloride, and with a second aqueous solution comprising 8.5% by weight of caustic soda and 2.5% by weight of sodium nitrite. The second solution is added in an amount such that the nitrite ion concentration in the treating bath does not exceed 0.3 mmol/l.

No special problems arise when a zinc phosphate solution of the type described above is replenished with replenishing compositions as indicated, provided the bath load is relatively high, i.e. the metal surface area treated per unit time per unit volume of bath is substantially greater, about 15 $m^2$ of metal surface per hour per $m^3$ of bath. On the other hand, if the zinc phosphate treatment is used with a low bath load, the amount of metal ion (e.g. zinc ion, nickel ion) replenishment required may be determined according to the relationship of treated area to coating weight per unit of surface area, i.e. the first replenisher is added as necessary to maintain the desired coating weight on the work being processed through the bath, alternatively replenisher is added to maintain zinc ion concentration and total and free acid levels within the operating ranges. However, at low bath loading, the accelerator, i.e., sodium nitrite, replenishment presents difficulties which are believed to be due to the consumption of accelerator, not resulting from the coating formation per se. The sodium nitrite accelerator in such bath undergoes a depolarizing action according to formula [1], spontaneous decomposition according to formula [2], and reaction with chlorate according to formula [3]:

$$NaNO_2 + H_3PO_4 \rightarrow NaH_2PO_4 + HNO_2 \quad [1]$$

$$HNO_2 + 3H^+ + 3e \rightarrow \tfrac{1}{2}N_2 \uparrow + 2H_2O$$

$$3NaNO_2 + 2H_3PO_4 \rightarrow 2NaH_2PO_4 + NaNO_3 + 2NO \uparrow + H_2O \quad [2]$$

$$NaClO_3 + NaNO_2 \rightarrow NaCl + 3NaNO_3 \quad [3]$$

As a result of the above, it has been found that when bath load is low, consumption of accelerator is determined by the amount of spontaneous decomposition with time rather than by surface area treated and, therefore, consumption of accelerator per unit of surface area treated eventually becomes extremely large. Consequently, the following problems tend to arise when the bath, in this method of treatment in combination with low bath load, is replenished with a conventional system without regard to bath load:

(1) As shown in formula [2], due to spontaneous decomposition of the accelerator, the free phsophoric acid is neutralized by the sodium ion, causing the pH to rise. The zinc ion, nickel ion, etc. in the treating bath, as well as the phosphate ion, cause formation of abnormal sludge while producing free phospheric acid.

$$3Me(H_2PO_4)_2 \rightarrow Me_3(PO_4)_2 \downarrow + 4H_3PO_4$$

This abnormal sludge is a white to pale green floating type sludge which forms upon collapse of the ion balance in the treating bath. The water content of this abnormal sludge at the time of filtration with an Excel filter is as high as 80 to 90% by weight in comparison to the water content of the normal sludge which is 40 to 70% by weight, and the Zn/Fe ratio of the abnormal sludge is 0.5 (wt/wt) or more in comparison to the Ze/Fe ratio of the normal sludge which is 0.35 to 0.20 (wt/wt).

(2) The normal sludge by-product of the coating forming reaction $$[\text{mainly iron phosphate: } Fe(H_2PO_4)_2 \xrightarrow{(O)} FePO_4 \downarrow + H_3PO_4]$$

and the above abnormal sludge are mixed together, and the whole composition becomes a sludge which precipitates much less readily.

(3) In the conventional sludge-removing method (e.g. filter paper, settling), either the filter paper is quickly blocked or settling takes a relatively long period of time (the abnormal sludge requires more than 10 times the amount of time needed for the normal sludge to settle), and thus the sludge starts to accumulate in the treating bath.

(4) Consequently, the sludge sticks to the treated article and causes a deterioration in the appearance of the zinc phosphate treated surface and in the appearance of the subsequently applied coatings.

As a result of extensive studies seeking to solve the abovementioned problem, it was found that maintaining the treating bath in a normal coating condition can be achieved under low bath load by utilizing the relation between the sodium nitrite reactions (spontaneous decomposition, depolarizing action, reaction with chlorate) and the bath load, i.e. metal surface area treated per hour per cubic meter of bath. The applicants found that it is important to maintain the balance of the component ions (phosphoric acid, zinc ion, and chlorate ion) to be supplied by the replenishing composition (Replenisher 1) in accordance with bath load. Similarly the accelerator concentration of the bath can be maintained by replenishing with nitrite (Replenisher 2) in accordance with the bath load.

Hence, the invention relates to an improvement for replenishing a zinc phosphate treating liquid, in which at least sodium nitrite is used as accelerator, to form a conversion coating on a metal surface immersed therein; the improvement comprising treating the metal surface at the rate of about 3 to about 15 $m^2$ per hour for each cubic meter of treating liquid and replenishing the free phosphoric acid by adding an amount of about 0.10 to about 0.31 moles for each 10 square meters of treated surface area. This process is normally carried out on a substantially continuous basis.

FIG. 1 is a graph showing the relationship between bath load and the quantity of free phosphoric acid required to replenish the bath.

As used herein, free phosphoric acid denotes phosphoric acid not neutralized with a metal ion (e.g. Zn, Ni, Fe, Na, or K ion) other than an H ion.

An example of the normal zinc phosphate treating bath of the present invention is an acidic treating liquid comprising zinc ion (0.5 to 1.5 g/l), phosphate ion (5 to 30 g/l), nickel ion (0.05 to 2 g/l), chlorate ion (0.05 to 2 g/l), nitrate ion (1 to 10 g/l) and nitrite ion (0.01 to 0.2 g/l), with a total acid titration of 14 to 25 points and a free acid titration of 0.2 to 1.5 points.

The characterizing feature of the invention comprises treating a metal surface at the rate of 3 to 15 $m^2$ per hour for each cubic meter of treating bath volume and replenishing the free phosphoric acid by adding an amount of about 0.10 to about 0.31 moles for each 10 square meters of treated surface area. When the amount replenished is below 0.10 moles, there occurs an imbalance in the component amounts of the bath, resulting in the formation of the abnormal sludge mentioned above. When said amount exceeds 0.31 moles, the substrate is subjected to an etching reaction, resulting in conversion coating defects such as lack of coating or yellow rust.

The first replenisher of the present invention may contain zinc ion and chlorate ion, in addition to the above free phosphoric acid, as in conventional replenishers. The replenishing amount of zinc ion for each 10 $m^2$ of treated surface may be 0.1 to 0.2 moles, preferably 0.12 to 0/18 moles. When the amount of zinc ion in the treating bath is too low, defects will occur in the conversion coating, such as lack of coating, blue color, etc. When the amount of zinc ion in the treating bath is excessive, formation of large amounts of zinc phosphate sludge will occur, ultimately leading to the formation of abnormal sludge. The replenishing amount of chlorate ion for each 10 $m^2$ of treated surface area may be 0.20 to 0.05 moles, preferably 0.17 to 0.06 moles. When the amount of chlorate ion in the treating bath is too low, it will cause an increase in the zinc phosphate coating weight, thereby lowering paint adhesion and corrosion-resistance. When the amount of chlorate ion in the treating bath is excessive defects will occur in the conversion coating, such as lack of coating or blue color.

Sources of such zinc ion are, for example, ZnO, $ZnCO_3$, $Zn(NO_3)_2$, $Zn(H_2PO_4)_2$. Sources of such phosphate ion are, for example, $H_3PO_4$, $NaH_2PO_4$, $Zn(H_2PO_4)_2$, $Ni(H_2PO_4)_2$. Sources of such chlorate ion are, for example, $NaClO_3$, $HClO_3$.

Furthermore, one or more of the following ions may be used to replenish the bath: nitrate ion (0 to 0.1 moles) for each 10 $m^2$ of treated surface area), complex fluoride ion such as $BF_4^{-1}$, $SiF_6^{-2}$ (0.003 to 0.03 moles for each 10 $m^2$ of treated surface), nickel ion (0.005 to 0.05 moles for each 10 $m^2$ of treated area), cobalt ion (0.005 to 0.05 moles for each 10 $m^2$ of treated surface area), calcium ion (0.001 to 0.05 moles for each 10 $m^2$ of treated surface area), manganese ion (0.005 to 0.05 moles for each 10 $m^2$ of treated surface area) and sodium ion (in an amount sufficient to neutralize the anion).

In the present invention, it is essential that at least 0.2 to 0.8 moles (for each 10 $m^2$ of treated surface area) of nitrite ion be added as accelerator replenishment.

The replenishing method of the invention in a zinc phosphate treating liquid with low bath load is effective in preventing the formation of abnormal sludge in the bath, and in continuously providing a good zinc phosphate coating for use as a subtrate for further coating, especially electrocoating, more particularly cathodic electrocoating.

The invention will be better understood from the following reference, actual and comparative examples, which are given for illustration purposes only and are not meant to limit the invention.

EXAMPLES

Reference Example 1

Using the zinc phosphate treating bath described in the ensuing actual examples, the amount of free phosphoric acid required to form a good zinc phosphate coating was measured in the laboratory by dipping the test pieces in a treating bath with a load in the range of about 3 to about 15 $m^2$/hour/$m^3$ while replenishing the zinc ion at the rate of 17 moles/1000 $m^2$. The results are shown in Table I.

TABLE I

| Bath load ($m^2$/hour/$m^3$) | 3 | 4 | 6 | 8 | 10 | 15 |
|---|---|---|---|---|---|---|
| Chlorate ion (moles/1000 $m^2$) | 16.0 | 15.0 | 13.7 | 11.8 | 10.4 | 8.1 |
| Free phosphoric acid (moles/1000 $m^2$) | 30.1 | 25.0 | 18.3 | 16.7 | 14.9 | 12.1 |

The above results are plotted in FIG. 1. The following equation for replenishing free phosphoric acid was determined from the resulting curve:

$Y=(0.7/X)+0.05$ to 0/09 (where Y is the number of moles of free phosphoric acid added for each 10 square meters of treated metal surface area and X is bath load expressed in $m^2$/hour/$m^3$).

Actual Examples 1–3

Commercial cold rolled steel (50x40x0.8 mm), pretreated by dipping in an alkaline degreasing agent (Nippon Paint Co., RIDOLINE SD 200, 2% by weight) for 2 minutes at 60° C., rinsing with water, and then dipping in a surface conditioner (Nippon Paint Co., FIXODINE 5N-5, 0.1% for 15 seconds, was treated continuously by the dipping process at a rate of 0.05, 0.1 or 0.15 $m^2$ of treated surface area per hour in 10 liters of zinc phosphate treating bath containing 1.0 g/l of zind ion, 0.5 g/l of nickel ion, 14 g/l of phosphate ion, 3 g/l of nitrate ion, 0.5 g/l of chlorate ion, and 0.08 g/l of nitrite ion at a total acid titration of 17.0, free acid titration of 0.9, toner value of 1.5, and temperature of 52° C.

In order to maintain the above-mentioned total acid titration and free acid titration, the ions were replenished at the rates shown in Table IIa, and the toner value was maintained by using 40% by weight aqueous sodium nitrite solution (toner).

After the conversion coating treatment, the cold rolled steel was rinsed with tap water and then with deionized water, and dried. The appearance and coating weight of the zinc phosphate treated steel plate obtained in this manner, and the amount and properties of the sludge in the treating bath are shown in Table IIa.

Legend appearance of the treated surface
- O: good
- X: sludge adhesion, irregularity
- XX: yellow rust in part of sludge adhesion sludge properties
- O: normal
- X: abnormal Also, * indicates the phosphate ion in the total phosphate compounds.

Comparative Examples 1–2

The treatment was carried out according to a procedure similar to the one described in the above actual examples, except that total acid titration, free acid titration, and the toner value of the zinc phosphate treating bath were maintained by replenishing at the rates shown in Table IIb.

As evident from the results shown in Tables IIa and IIb, in the replenishing method of the invention, a good zinc phosphate coating can be formed, and the floating sludge can be maintained within the normal range. In the comparative examples, a slurry-like sludge is gradually formed, then begins to accumulate and float in the treating bath. A normal treating bath cannot be maintained under these circumstances, even when reducing the rate at which the bath is stirred and the sludge, therefore, tends to adhere to the treated work piece, causing a deterioration in the appearance of the treated metal surface.

Brief Description of the Diagram

FIG. 1 shows the relationship between bath load and amount of free phosphoric required to replenish the bath, as determined in Reference Example 1.

TABLE IIa

| | | Actual Example 1 | Actual Example 2 | Actual Example 3 |
|---|---|---|---|---|
| Bath load ($m^2$/hour/ton) | | 5 | 10 | 15 |
| Number of moles replenished per 1000 $m^2$ of treated surface area | Zinc ion | 17 | 18 | 15 |
| | Nickel ion | 2.0 | 1.0 | 3.0 |
| | Calcium ion | 0.02 | 0 | 0 |
| | Phosphate ion* | 55 | 50 | 48 |
| | Chlorate ion | 13 | 9 | 7 |
| | Nitrate ion | 0 | 0 | 0.01 |
| | Free phosphoric acid | 20 | 14 | 12 |
| | Nitrite ion | 60 | 38 | 27 |
| Appearance of treated metal surface and coating weight (g/$m^2$) | At start up | O 2.6 | O 2.6 | O 2.6 |
| | After 24 hrs. | O 2.6 | O 2.7 | O 2.6 |
| | After 100 hrs. | O 2.7 | O 2.6 | O 2.6 |
| | After 300 hrs. | O 2.8 | O 2.7 | O 2.6 |
| Amount of floating sludge (ppm) and its properties | At start up | 50 O | 50 O | 50 O |
| | After 24 hrs. | 110 O | 210 O | 280 O |
| | After 100 hrs. | 300 O | 340 O | 320 O |
| | After 300 hrs. | 380 O | 370 O | 390 O |

TABLE IIb

| | | Comparative Example 1 | Comparative Example 2 |
|---|---|---|---|
| Bath load ($m^2$/hour/ton) | | 5 | 15 |
| Number of moles replenished per 1000 $m^2$ of treated surface area | Zinc ion | 17 | 23 |
| | Nickel ion | 2.0 | 3.0 |
| | Calcium ion | 0.02 | 0 |
| | Phosphate ion* | 45 | 48 |
| | Chlorate ion | 13 | 4 |
| | Nitrate ion | 0 | 0.01 |
| | Free phosphoric acid | 8 | 12 |
| | Nitrite ion | 60 | 27 |
| Appearance of treated metal surface and coating weight (g/$m^2$) | At start up | O 2.6 | O 2.6 |
| | After 24 hrs. | X 2.1 | O 3.0 |
| | After 100 hrs. | XX 1.8 | X 3.4 |
| | After 300 hrs. | XX 1.2 | XX 1.5 |
| Amount of floating sludge (ppm) and its properties | At start up | 50 O | 60 O |
| | After 24 hrs. | 520 X | 380 O |
| | After 100 hrs. | 1860 X | 1500 X |
| | After 300 hrs. | 5900 X | 5700 X |

What is claimed is:

1. In a method for forming a conversion coating on a metal surface by immersing said metal surface in an acidic zinc phosphate treating liquid comprising zinc ion (0.5 to 1.5 g/l), phosphate ion (5 to 30 g/l), nickel ion (0.5 to 2 g/l), chlorate ion (0.05 to 2 g/l), nitrate ion (1 to 10 g/l) and nitrite ion (0.01 to 0.2 g/l) and having a total acid titration of 14 to 25 points and a free acid titration of 0.2 to 1.5 points, the improvement which comprises treating the metal surface at a rate of 3 to 15 $m^2$ per hour per cubic meter of treating liquid and replenishing said acidic zinc phosphate treating liquid, without testing the bath concentrations thereof, by adding a first replenishing composition comprising about 0.10–0.31 moles of phosphoric acid, 0.1 to 0.2 moles of zinc ion and 0.05 to 0.20 moles of chlorate ion for each 10 square meters of treated metal surface area, and a second replenishing composition comprising 0.2 to 0.8 moles of nitrite ion for each 10 square meters of treated metal surface area.

2. A method according to claim 1, wherein the first replenishing composition comprises about 0.10–0.31 moles of phosphoric acid, 0.12 to 0.18 moles of zinc ion and 0.06 to 0.17 moles of chlorate ion for each 10 square meters of treated metal surface area.

3. A method for replenishing a zinc phosphate treating bath which contains free phosphoric acid, nitrite ion, and zinc ion for forming zinc phosphate coatings on metal surfaces comprising maintaining the treatment of the metal surfaces at a rate of from about 3 to about 15 $m^2$/hour for each cubic meter of treating bath, and replenishing the $H_3PO_4$, nitrite ion, and zinc ion components of the treating bath, without testing the bath concentrations thereof, at the following rates:

(a) $H_3PO_4$ at the rate of from about 0.10 to about 0.31 moles for each 10 square meters of treated metal surface area;

(b) nitrite ion at the rate of from about 0.2 to about 0.8 moles for each 10 square meters of treated metal surface area; and (c) zinc ion at the rate of from about 0.1 to about 0.2 moles for each 10 square meters of treated metal surface area.

4. The method according to claim 3, wherein a chlorate ion is also present in the bath and is replenished by adding an amount of about 0.20 to about 0.05 moles for each 10 square meters of treated metal surface area.

5. A method in accordance with claim 3 wherein the zinc ion (c) is replenished at the rate of from about 0.12 to about 0.18 moles for each 10 square meters of treated metal surface area.

6. A method in accordance with claim 4 wherein the chlorate ion is replenished at the rate of from about 0.06 to about 0.17 moles for each 10 square meters of treated metal surface area.

* * * * *